United States Patent [19]

Holmes

[11] 4,135,273

[45] Jan. 23, 1979

[54] HINGE WITH INTERFITTING LOCKING MEANS

[76] Inventor: Stannard D. Holmes, Box 331, Naranjito, P.R. 00719

[21] Appl. No.: 871,442

[22] Filed: Jan. 23, 1978

[51] Int. Cl.[2] ..... E05D 5/12

[52] U.S. Cl. ..... 16/169; 16/137; 16/DIG. 33

[58] Field of Search ..... 16/134, 137, 139, 140, 16/143, 168, 169, 176, DIG. 13, DIG. 33

[56] References Cited

U.S. PATENT DOCUMENTS

| | | | |
|---|---|---|---|
| 905,201 | 12/1908 | Magnusen | 16/137 |
| 1,721,288 | 7/1929 | Thiry | 16/DIG. 33 |
| 2,817,871 | 12/1957 | Ferry | 16/169 |
| 2,824,464 | 2/1958 | Remington | 16/169 UX |
| 2,937,399 | 5/1960 | De Vore | 16/169 |
| 3,104,416 | 9/1963 | Barker | 16/140 |
| 3,216,053 | 11/1965 | Felix | 16/169 X |
| 3,805,325 | 4/1974 | Lee | 16/137 |

FOREIGN PATENT DOCUMENTS

| | | | |
|---|---|---|---|
| 502999 | 7/1930 | Fed. Rep. of Germany | 16/137 |
| 1107230 | 8/1955 | France | 16/134 |

*Primary Examiner*—Werner H. Schroeder
*Assistant Examiner*—Moshe I. Cohen
*Attorney, Agent, or Firm*—Scrivener, Parker, Scrivener and Clarke

[57] ABSTRACT

A hinge for doors and the like is provided in which an un-headed hinge pin is held frictionally in the axial passage through a cylindrical plastic retainer which is centrally positioned between, and is aligned with, interlocking bosses which extend toward each other from the two leaves of the hinge. Interfitting locking means are also provided in the two leaves whereby the hinge may be locked in closed position.

3 Claims, 3 Drawing Figures

HINGE WITH INTERFITTING LOCKING MEANS

BRIEF SUMMARY OF THE INVENTION

The two leaves of the hinge are provided with cylindrical bosses which are aligned in the assembled position of the hinge, leaving a centrally located open space within which a cylindrical plastic retainer is positioned. An un-headed hinge pin extends through the aligned bosses and the retainer and is held in position by a friction fit within the retainer and within two bushings which are respectively received within two of the bosses. One of the hinge leaves is provided with an opening and the other is provided a struck-out part which is received within the opening in the other leaf in the closed position of the hinge to provide means whereby the hinge may be locked in closed position.

DESCRIPTION OF THE INVENTION

Figure 1:
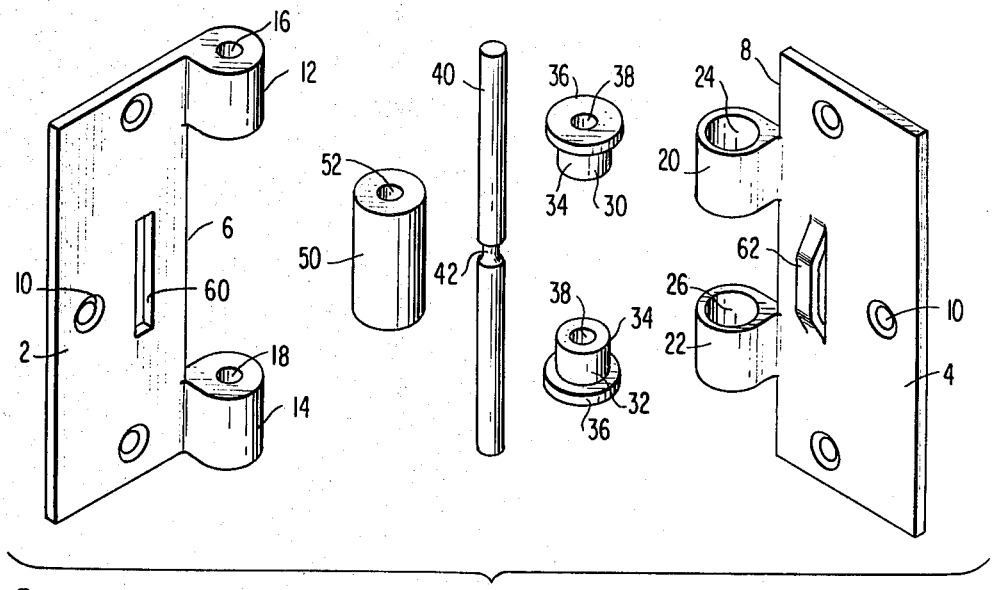
FIG. 1 is an exploded perspective view of the parts of the hinge provided by the invention.

The hinge provided by the invention comprises two flat leaves 2, 4 which are pivotally connected along their facing edges 6, 8 by the means provided by the invention. These leaves may be of any desired shape, and are preferably provided with openings 10 whereby they may be attached to the door and jamb or other corresponding parts.

The means for pivotally connecting the two hinge leaves comprise, first, two cylindrical bosses 12, 14 which are respectively connected to the edge 6 of leaf 2 at the opposite ends thereof and which extend toward the other leaf in the assembled position of the hinge. These bosses are provided with aligned axial openings 16, 18 for the reception of the hinge pin. The second leaf 4 is also provided with two cylindrical bosses 20, 22 which extend outwardly from the edge 8 of the leaf in the direction of leaf 2 in the assembled condition of the hinge. These bosses have aligned axial openings 24, 26 therethrough which are larger in diameter then the openings 16, 18 in bosses 12, 14.

The bosses 20, 22 are spaced apart by a distance which is described later, and are so positioned on the leaf 4 that when the two leaves are brought together with the edges 6, 8 in juxtaposed relation the bosses 20, 22 will be positioned between the bosses 12, 14 and the outer edges of bosses 20, 22 will be spaced by a small distance from the inner edges of bosses 12, 14.

Two bushings 30, 32 are provided, each of which has a cylindrical body portion 34, the external diameter of which permits it to be driven or screwed into one of the other of the openings 24, 26 through bosses 20, 22, and also is provided with an enlarged flat cap 36 which overlies the end of the boss after the bushing has been positioned within the boss. Each of the bushings has an axial opening 38 therethrough, the diameter of which is equal to that of the passages 16, 18 through bosses 12, 14 and is also equal to the diameter of the hinge pin which holds all of the parts together.

A hinge pin 40 is provided which is cylindrical and is not provided with a head at either end, and at the midpoint thereof is provided with a reduced diameter part 42. A hinge pin retainer 50 is also provided and is cylindrical in shape and has an axial passage 52 therethrough having a reduced diameter section 54 at the midpoint thereof. This retainer is preferably made of a soft plastic material and the diameter of the axial opening therethrough is slightly less than the diameter of the hinge pin so that the hinge pin may be driven through the axial opening and will be held resiliently in place within the opening with the reduced diameter part of the retainer positioned within the reduced diameter part at the midpoint of the length of the hinge pin. The length of the retainer is equal to the spacing between the adjacent ends of the bosses 20, 22 of hinge leaf 4.

Figure 2:
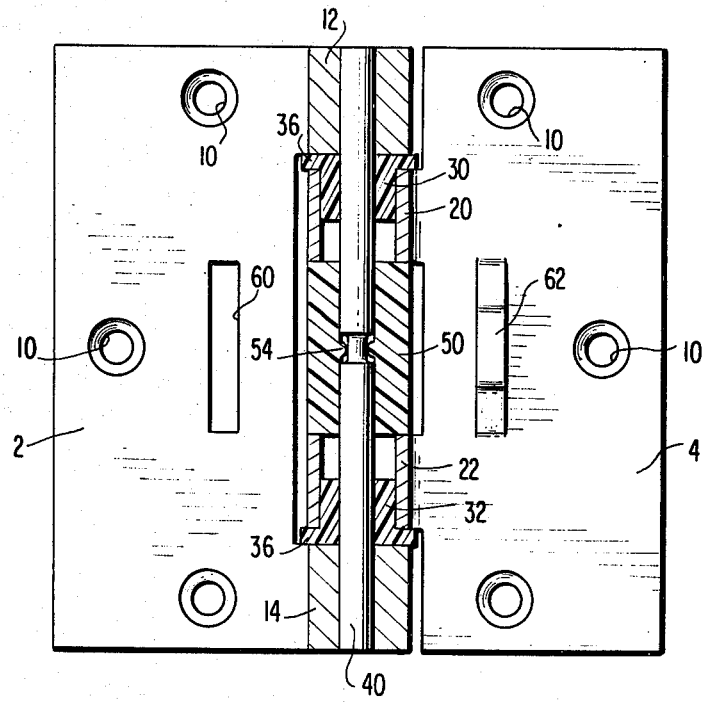
FIG. 2 is a plan view of the assembled hinge.
Figure 3:
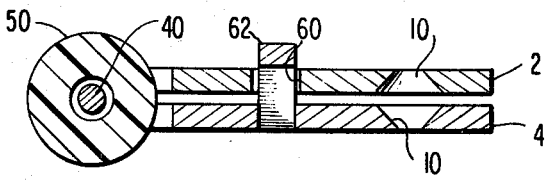
FIG. 3 is a transverse cross sectional view of the hinge in closed position.

The assembled position of the hinge is shown in FIG. 2, and in this assembled position the bushings 30, 32 have been driven into the aligned openings in the bosses 20, 22 with the heads 36 of the bushings in contact with the outer end surfaces of the two bosses. The retainer 50 is now positioned between the bosses 20, 22 and the hinge leaves brought together with the openings 16, 18 in the bosses 12, 14 of hinge leaf 2 aligned with the openings 38 through the bushings 30, 32 and the opening 52 through the retainer 50. The hinge pin is now passed through opening 16 in boss 12 opening 38 through bushing 30, opening 52 through retainer 50, opening 38 through bushing 32 and opening 18 through boss 14. The hinge pin will be held firmly in position in these assembled parts by its frictional engagement with the wall of the opening through the retainer and by the engagement between the reduced diameter part 54 within the retainer and the reduced diameter part 42 at the midpoint of the hinge pin. The length of the hinge pin is preferably made equal to the distance between the outer edges of the bosses 10, 12 so that it will not protrude from the assembled hinge at either end thereof.

Means are provided by the invention for permitting the two leaves of the hinge to be locked together in the closed position of the hinge. Such means comprise a preferably rectangularly opening 60 formed in and through hinge leaf 2 and a part 62 which is struck up from the other hinge leaf 4 and which preferably has the same shape as the opening 60 and which is so formed that when the two hinged leaves are brought together the part 62 extends through the opening 60 to the outside of the hinge leaf 2 so that means can be positioned between part 62 and the outer face of the hinge 2 so that the hinge cannot be opened until the locking means is removed.

I claim:

1. A hinge comprising first and second leaves of substantially equal length, an unheaded hinge pin pivotally connecting the leaves along adjacent edges and being substantially equal in length to the leaves, the first leaf having two spaced aligned cylindrical bosses positioned at the opposite ends thereof and having aligned openings therethrough of the same diameter as the hinge pin, the second leaf having two spaced aligned cylindrical bosses positioned between the bosses of the first leaf and being of such length and position that their outer end surfaces are respectively spaced from the inner end surfaces of the bosses of the first leaf and having aligned openings therethrough which are of larger diameter than the diameter of the hinge pin, a headed bushing within each boss of the second leaf having its head within and filling the space between the bosses of the first and second leaves with which it is associated, each of said bushings having an opening therethrough of the same diameter as the hinge pin, a cylindrical retainer separate from the two leaves formed of a resilient material and positioned between the bosses of the second leaf and having an axial opening therethrough aligned with the openings through the bosses of the first leaf and those through the bushings and the diameter of which is such that the hinge pin is resiliently engaged by the material of the retainer and relative rotation between them is permitted, the hinge pin extending through the aligned openings in the bosses of the first leaf, the openings in the bushings in the bosses of the second leaf and the opening in the retainer.

2. A hinge according to claim 1, comprising an opening through one of the leaves and a part struck-up from the other leaf and positioned to pass through the opening in the one leaf when the two leaves are brought in face-to-face relation, the struck-up part being shaped as an open loop and being of such size that the open part of it extends above the outer surface of the one leaf in the face-to-face position of the leaves to permit a locking member to be extended through it to prevent movement of the leaves from their face-to-face condition.

3. A hinge according to claim 1, in which the hinge pin has a part of the reduced diameter at the midpoint of its length and the opening through the retainer has a reduced diameter part within the reduced diameter part of the hinge pin to resiliently and releaseably prevent longitudinal movement of the hinge pin with respect to the other parts of the hinge.

* * * * *